US007334775B2

(12) United States Patent
Jacquinot et al.

(10) Patent No.: US 7,334,775 B2
(45) Date of Patent: Feb. 26, 2008

(54) DEVICE FOR OPENING, BY MEANS OF FORCE, DOORS, WINDOWS AND OTHER TYPES OF OPENINGS, WITH A REMOTE CONTROL

(76) Inventors: Bernard Jacquinot, 1 place Jules Renard, 75017 Paris (FR); Jean-Michel Gerard, Les Louvières, 39800 Colonne (FR)

( * ) Notice: Subject to any disclaimer, the term of this patent is extended or adjusted under 35 U.S.C. 154(b) by 110 days.

(21) Appl. No.: 10/543,778

(22) PCT Filed: Jan. 29, 2004

(86) PCT No.: PCT/FR2004/000200

§ 371 (c)(1),
(2), (4) Date: Apr. 14, 2006

(87) PCT Pub. No.: WO2004/069340

PCT Pub. Date: Aug. 19, 2004

(65) Prior Publication Data

US 2006/0192187 A1 Aug. 31, 2006

(30) Foreign Application Priority Data

Jan. 29, 2003 (FR) ..... 03 00966

(51) Int. Cl.
*A62B 3/00* (2006.01)
*B66F 3/24* (2006.01)

(52) U.S. Cl. ..... 254/93 R; 254/89 H; 254/134

(58) Field of Classification Search ..... 254/93 R, 254/100, 134, 89 H; 29/237, 239
See application file for complete search history.

(56) References Cited

U.S. PATENT DOCUMENTS

| | | | | |
|---|---|---|---|---|
| 4,113,234 | A | 9/1978 | Wride | |
| 4,657,225 | A | 4/1987 | Hoehn et al. | |
| 4,762,304 | A | 8/1988 | Hill | |
| 5,088,174 | A | 2/1992 | Hull et al. | |
| 5,937,683 | A * | 8/1999 | Chartier | 72/21.5 |
| 6,286,813 | B1 | 9/2001 | Coccaro | |

FOREIGN PATENT DOCUMENTS

| | | |
|---|---|---|
| EP | 0 271 207 | 11/1987 |
| EP | 0 750 922 A2 | 6/1996 |
| GB | 2236803 | 9/1989 |
| NL | 9200881 | 5/1992 |

* cited by examiner

*Primary Examiner*—Lee D. Wilson
(74) *Attorney, Agent, or Firm*—Clark & Brody

(57) ABSTRACT

The invention relates to a device for opening, by way of force, an operating sash (100) which has a length (L) and which comprises an opening part (102) and a fixed frame (104), such as a door or window, comprising at least one frame (2) whose length can be extended and which is formed by one or several sliding parts (10,20) which can be adapted to the length (L) of the operating sash; a corner (12,22) which can be depressed and which is arranged in between the frame (104) and the opening part (102), a spreader ram (50) enabling the penetration of said corner (12,22) between the frame (104) and the opening part (102) in order to open the operating sash (100) by way of force; and a push ram (30) placed in a substantially perpendicular position with respect to the frame (2). The rams (30;50) can be maneuvered at a distance with the aid of a remote control (80). The invention is characterized in that the push ram (30) is a continually thrusting percussion ram acting in a repetitive reciprocating manner.

18 Claims, 4 Drawing Sheets

DEVICE FOR OPENING, BY MEANS OF FORCE, DOORS, WINDOWS AND OTHER TYPES OF OPENINGS, WITH A REMOTE CONTROL

FIELD OF THE INVENTION

The invention relates to a device for forcibly opening doors, windows and other opening leaves, with its remote control.

BACKGROUND OF THE INVENTION

To date, the fire brigades or any other trade associations called upon to perform an urgent intervention such as the police force or the constabulary, engineering corps, mobile response units of the police-based GIGN or GIPN type, encounter difficulties in entering apartments, private homes, industrial and commercial premises in the context of emergency intervention. Specifically, these difficulties are usually associated with the strength of the armored doors which are able for between 15 and 20 minutes to resist the force of a mass manipulated by the firefighters, who are therefore sometimes exhausted or less responsive and less effective when confronted with the danger, especially in the event of fire. By way of information, there are five reference levels concerning single-leaf or double-leaf armored doors. The FIG. 5 is the highest level of resistance to break-in with a resistance to deformation upwards of four tonnes of thrust. This type of door is thus equipped with a six-point lock, with pistons 18 mm in diameter made of toughened steel and penetrating 40 mm into a toughened steel frame 3 mm thick.

Equipment for breaking down armored doors, called "door breakers" already exist but these are not suitable for the fire brigade because they are heavy, bulky and not very maneuverable, are not very effective, take a long time to work and are of limited use. Now, in an emergency intervention, particularly in the event of fire or where there is a risk of intoxication, each second lost in opening the door is an additional risk of sustaining damage and casualties, both on the part of the individuals requiring assistance and on the part of the firefighters.

BRIEF SUMMARY OF THE INVENTION

In order to solve these problems, the invention proposes to provide a device for forcibly opening opening leaves, such as doors or windows, portable, with a significant striking force for better effectiveness, easy to use and secure.

More specifically, the subject of the invention is to provide a device for forcibly opening an opening leaf of width having an opening part and a fixed frame such as a door or window, comprising at least:

- a length-extendable body formed of two or more sliding parts so that it can be adapted to suit the width of the opening leaf,
- a drive-in wedge intended to be positioned between the frame and the opening part,
- a parting ram to allow the wedge to penetrate between the frame and the opening part so as to forcibly open the opening leaf, and a thrusting ram placed substantially at right angles to the body, the rams being remotely operable using at least one remote control, in which the thrusting ram is a continuous-thrust percussion ram with repetitive reciprocating action.

According to some preferred embodiments of the invention:

- the body comprises an outer sleeve inside which an inner sleeve slides, a first, sharpened, drive-in wedge being secured to the outer sleeve and a second, sharpened, drive-in wedge being secured to the inner sleeve;
- the wedges are positioned in an offset manner at the two opposing ends of the body and each have substantially the shape of an "L";
- the parting ram is fixed, inside the inner sleeve, on a mounting plate and allows the wedges to be driven in before the percussion thrust ram is operated;
- the percussion thrust ram is slidably mounted on a ramp that positions it in the desired location, said ramp extending over practically the entire length of the outer sleeve. As a preference, the ramp is of the dovetail type;
- the percussion thrust ram comprises a bellows to which there is secured a rigid bearing plate that can be positioned facing the opening part of the opening leaf;
- the bellows is made of flexible and pressure-resistant plastic so that the bearing plate has a possible angular deformation of between 0° and substantially 20° about three perpendicular axes of rotation;
- the body comprises a blocking member blocking longitudinal translation to allow the two sliding parts to be locked together before the percussion pressure ram is operated;
- the blocking member comprises at least a longitudinal rack arranged on the internal surface of the outer sleeve and equipped with blocking teeth, an articulated pawl collaborating with the rack in order to be in or out of mesh with said teeth, and a return spring for returning the pawl;
- the blocking member advantageously comprises two identical racks arranged substantially in opposition on the internal surface of the outer sleeve, two articulated pawls mounted on a common slide secured to the rod of the parting ram and connected to one another by two return springs, and two lugs secured to a blanking plate of the inner sleeve and collaborating with the pawls to keep them in the knocked-over position against the return force of the springs;
- each ram is of the pneumatic type and has a respective quick coupling to a pressurized-air cylinder, and an exhaust valve;
- the remote control is connected to the rams by fire-resistant and crush-resistant flexes between one and several meters long, and has independent and easy-to-distinguish controls for each ram;
- the ram controls are push-buttons and the button for controlling the parting ram is more prominent on the remote control than the button for controlling the thrust ram;
- the body has, at one end, a housing of the dovetail type arranged at right angles to its main direction of elongation so as to hold an extension piece;
- the body has two fixed or articulated handgrips arranged at its two opposite ends and made of a material resistant to violent impacts, to fire and to corrosion, such as titanium;
- the parting ram has a power of between 5 and 20 kN, preferably of 13.5 kN, and a stroke of about 50 to 100 mm, and the percussion thrust ram has a power of between 10 and 70 kN, advantageously between 25 and 50 kN, and preferably of substantially 45 kN, and a stroke of between about 50 and 200 mm;
- advantageously, the device is mainly made of a material exhibiting high mechanical strength and high resistance to fire and to corrosion, such as titanium; and the device can be used in parallel with other identical devices connected to one another by quick couplings and operated using the same remote control.

BRIEF DESCRIPTION OF THE DRAWINGS

Other characteristics, details and advantages of the invention will become apparent from the description which follows, given with reference to the attached drawings given by way of example and which respectively depict.

DETAILED DESCRIPTION OF THE INVENTION

Figure 1:
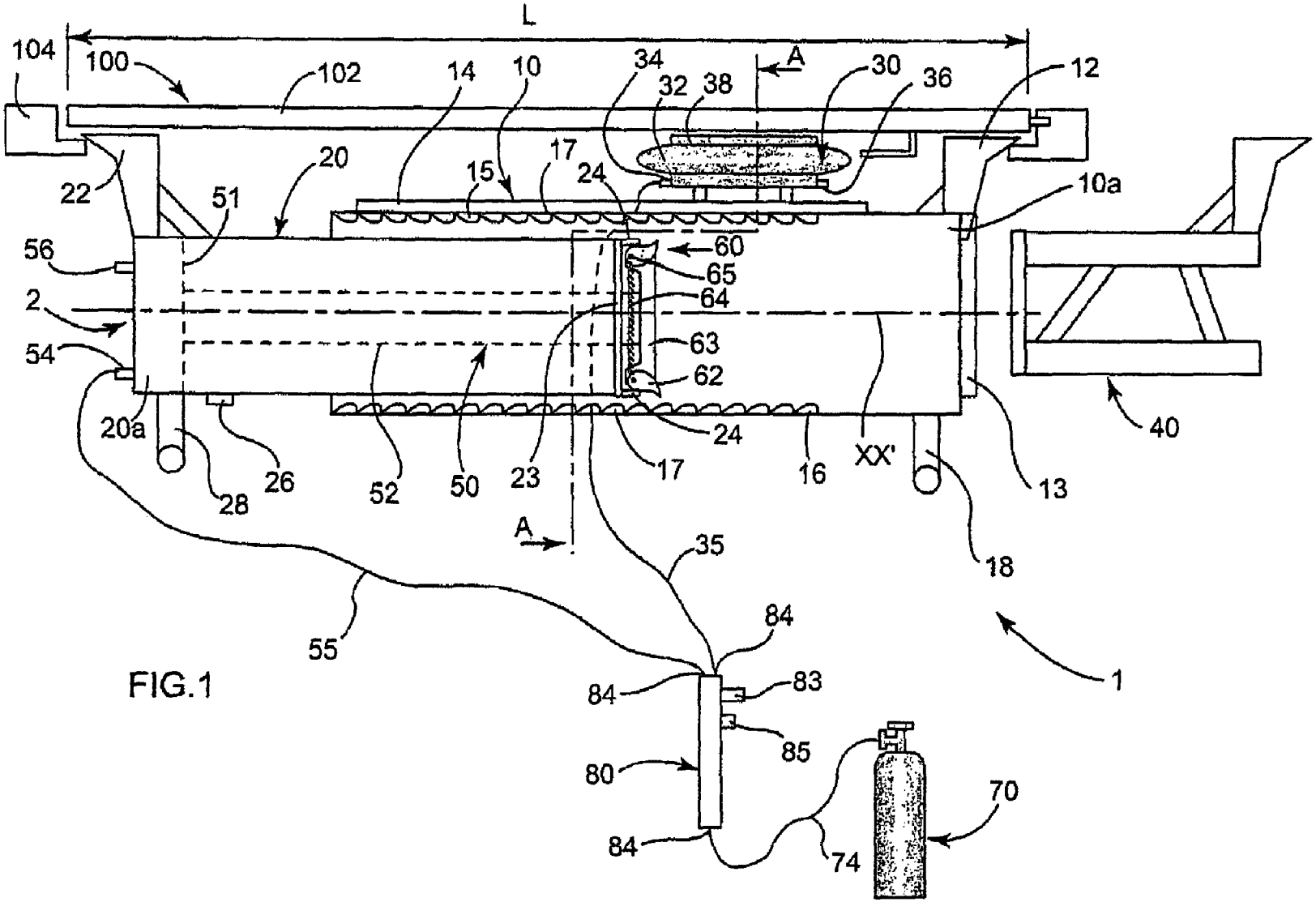
FIG. 1, a view in section of a device for forcibly opening an opening leaf according to the present invention, FIG. 2, a front-on view of the device of FIG. 1, FIG. 3, a view in section on AA of FIG. 1, FIGS. 4 and 5, views of details of FIG. 1.
Figure 2:
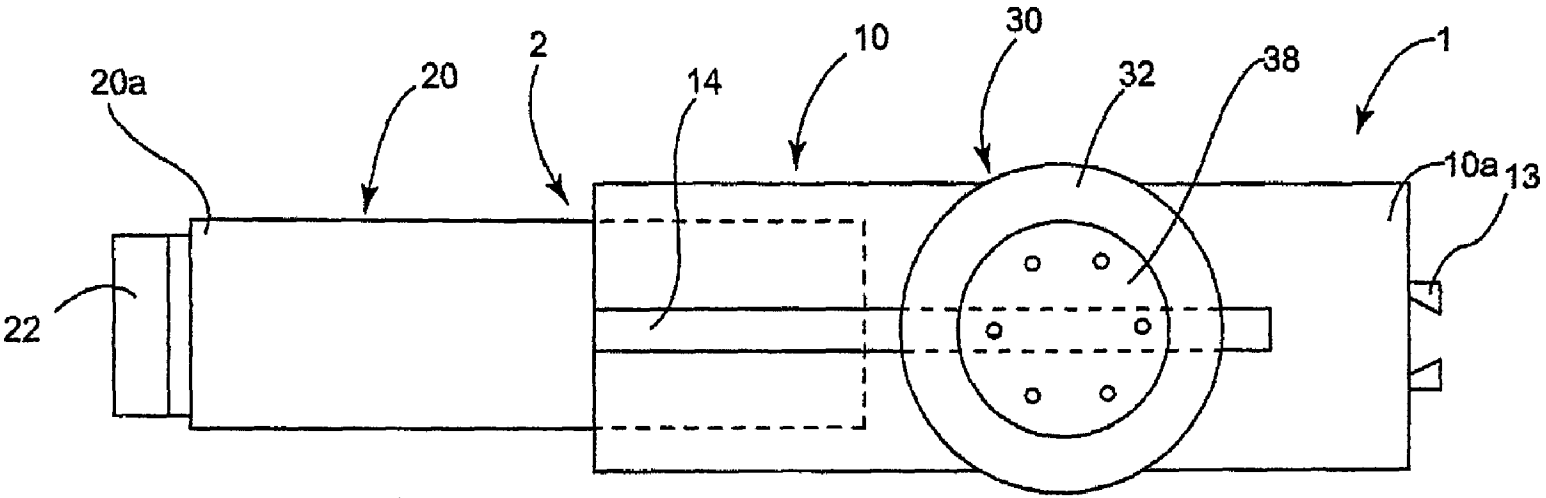
Figure 3:
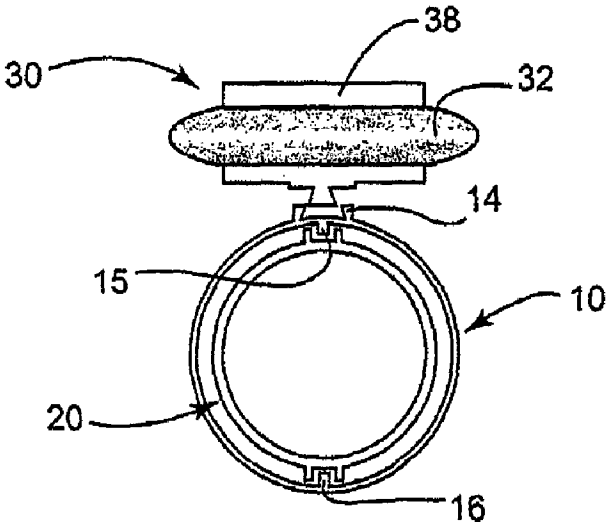

FIGS. 1 to 3 depict a device 1 for forcibly opening an opening leaf such as a door, for example an armored door, or a window.

This device 1 comprises a substantially circular body 2 of longitudinal axis XX' that can be extended manually in terms of length and is formed of at least two sliding parts so that it can be adapted to suit any type of opening leaf, particularly a door 100 of width L. The body thus comprises an outer sleeve 10, inside which there slides an inner sleeve 20, and a percussion thrust ram 30 mounted to move on the outer sleeve 10. The two sleeves 10 and 20 are made of a metal with high mechanical strength, such as titanium.

The outer sleeve 10 comprises, at a free end 10*a*, a first drive-in wedge 12 of offset position. This first wedge, made of very sharpened and non-deformable titanium and substantially in the shape of an L, is for example welded to the outer sleeve 10 via reinforcing struts. A housing 13 of the dovetail type is also provided at the end 10*a*, at right angles to the main direction of elongation of said outer sleeve 10. This housing 13 is able to hold an extension piece 40 intended to increase the useful length of the opening device 1. The outer sleeve 10 also comprises a longitudinal ramp 14 for displacing and positioning the thrust ram 30, also of the dovetail type, as depicted in greater detail in FIG. 3. The ramp measures practically the entire length of the outer sleeve 10.

Figure 4:
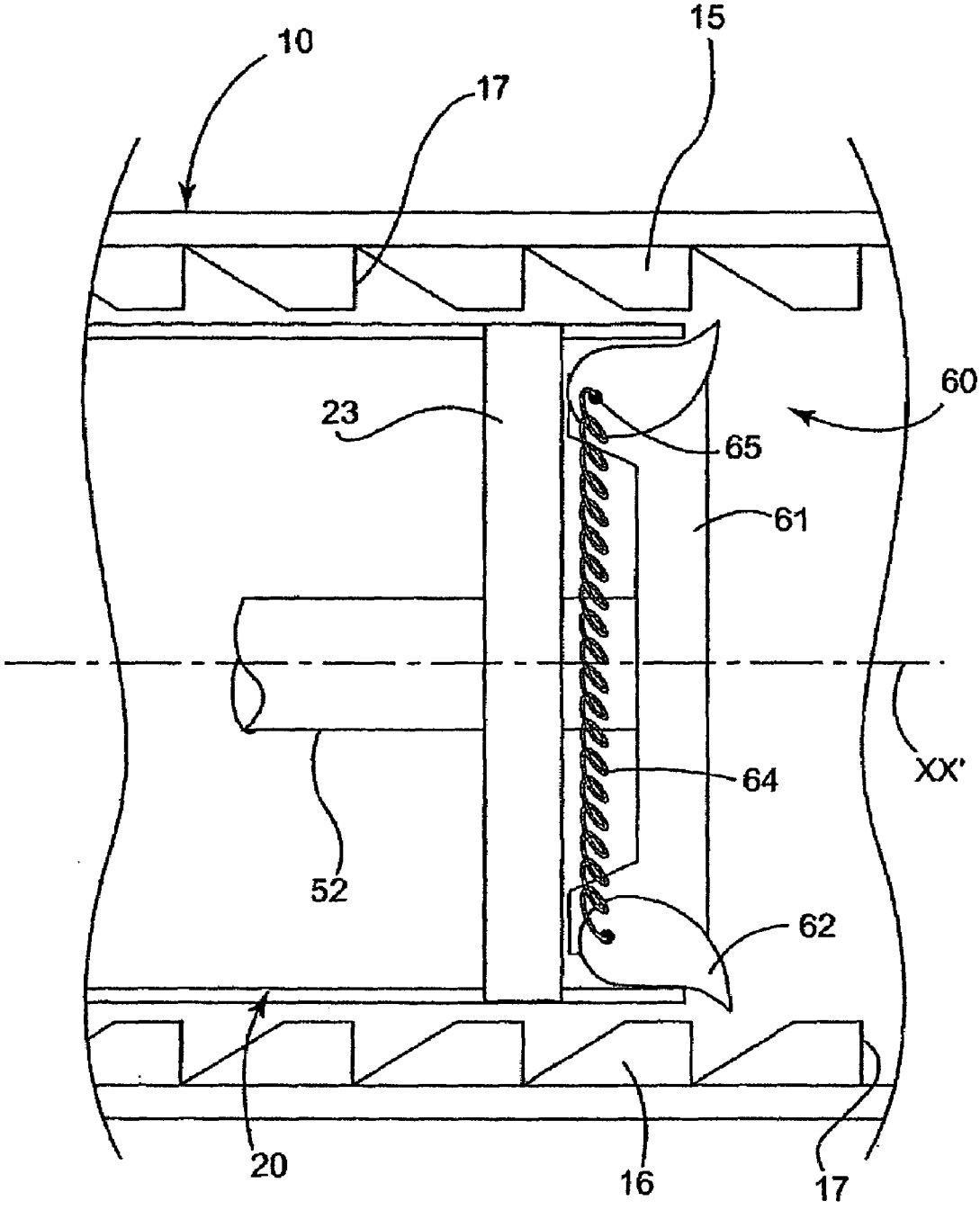
Figure 5:
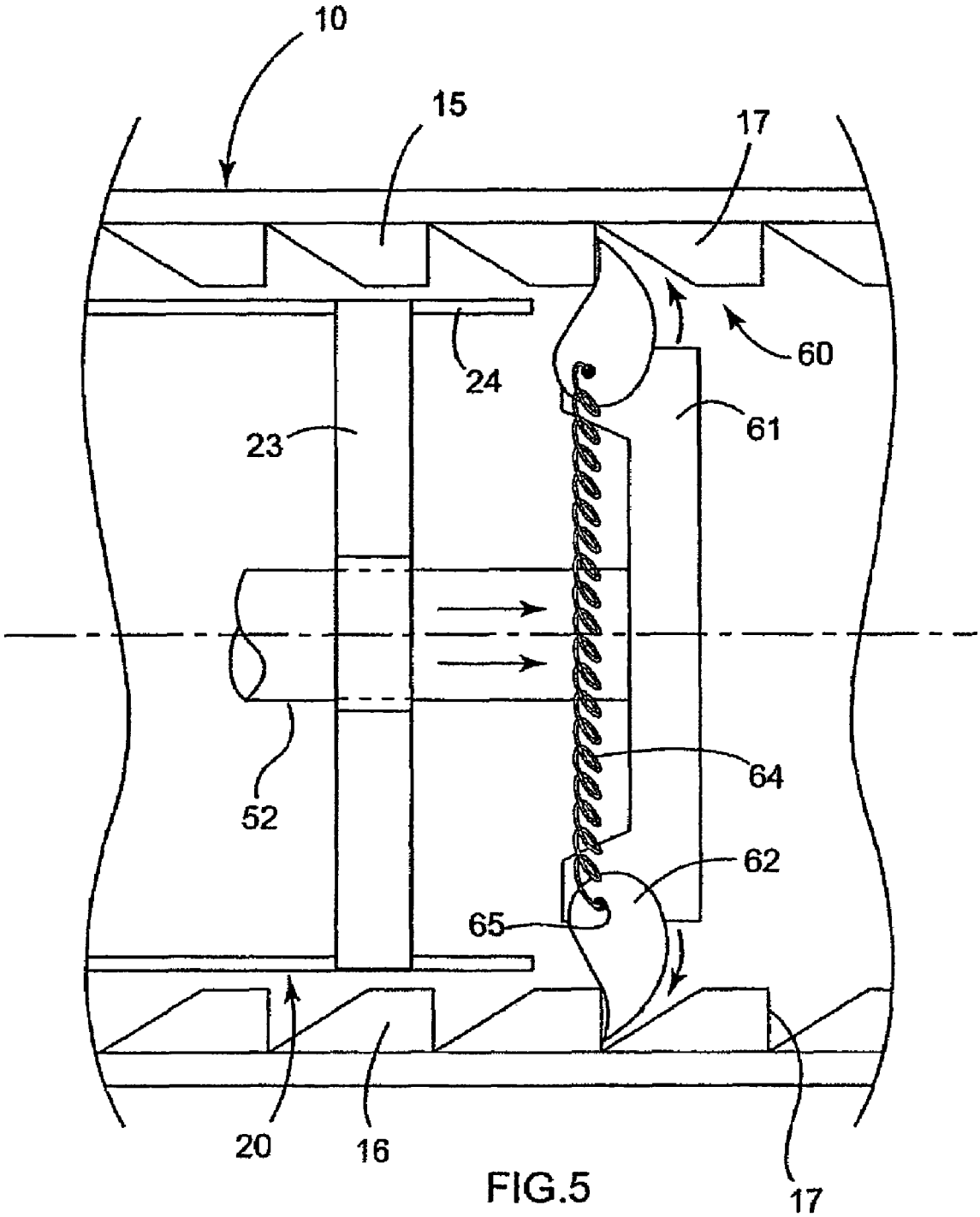

As can be seen in FIGS. 1, 4 and 5, the outer sleeve 10 comprises a first longitudinal rack 15 placed on the back of the ramp 14, and a second longitudinal rack 16 identical to the first, also arranged inside the outer sleeve, but in opposition with the first rack 15. Each rack 15 and 16 is equipped with respective blocking teeth 17.

A solid handgrip 18 made of titanium is also welded near the end 10*a* of the outer sleeve, on the opposite side to the first wedge 12.

The inner sleeve 20 comprises, at a free end 20*a*, a second drive-in wedge 22 of offset position similar to the first wedge 12 of the outer sleeve 10. The inner sleeve 20 contains a pneumatic ram 50 screwed to a rear mounting plate 51, and the central rod 52 of which emerges from a blanking plate 23.

A blocking member 60 comprises, apart from the racks 15 and 16, a slide 61 screwed to the free end 52*a* of the ram rod 52 and collaborating with the outer sleeve 10. The blocking member 60 also comprises two pawls 62 articulated about axes 65 formed in the slide 61. The pawls 62 are placed in opposition with respect to one another, back to back, and each positioned facing one of the racks 15 or 16. Two return springs 64 connect the pawls at their axes. The plate 23 also has two lugs 24 facing axially to allow the pawls 62 to be held in position against the return force of the return springs 64.

A second handgrip 28 is also welded near the end 20*a* of the inner sleeve 20, parallel to the first handgrip 18.

The parting ram 50 is equipped with a quick coupling 54 to a pressurized air cylinder 70 via a fire-resistant and crush-resistant flex 55, and with a remote control 80, and with a valve 56. A first button 26 for operating the ram 50 is provided near the second handgrip 28.

The thrust ram 30 is mounted to slide on the outer sleeve 10 via a connection of the dovetail type with the longitudinal ramp 14. The thrust ram 30 can thus move over practically the entire length of the outer sleeve 10. This ram 30 comprises a sealed bellows 32, for example made of reinforced rubber, a quick coupling 34 to a compressed air cylinder 70 via a fire-resistant and crush-resistant flex 35 and the remote control 80, an exhaust valve 36 and a rigid bearing plate 38.

The remote control 80 comprises quick couplings 84 for the flexes 55 and 35 departing to the rams 30 and 50, and for a flex 74 departing to the pressurized gas cylinder 70. Two buttons 83 and 85 are provided for controlling the parting ram 50 and the thrust ram 30 respectively. These buttons are readily identifiable, even blind, for example in smoke and/or when wearing respiratory equipment over one's face. For this purpose, the second button 83 is more prominent than the third button 85.

The principle of operation of the device according to the invention is as follows. The device, held by its handgrips 18 and 28 by the operator is placed in any position whatsoever between the uprights of the door, for example horizontally, slightly inclined, or vertically. The two sleeves are parted manually so as to position the titanium wedges 12 and 22 between an opening part 102 and a lateral frame 104 of the door 100.

The thrust ram 30 is maneuvered along the ramp 14 to place it as close as possible to the lock 105 of the door 100.

Once this position, illustrated by FIG. 4, has been reached, the operator presses the first button 26 secured to the device 1 to trigger the arrival of pressurized air in the parting ram 50. During this slow pressurizing, the parting ram 50 drives its rod 52 to part the outer sleeve 10 from the inner sleeve 20 over a few millimeters to a few centimeters, typically between 50 and 100 mm, and this has the effect of causing the wedges 12 and 22 to penetrate somewhat deeply into the frame 104 of the door 100. At the same time, the two pawls 62 of the blocking member 60 pivot step by step as the sleeves part and as the lugs 24 move away from said pawls 62, then engage with the teeth 17 of the two racks 15 and 16 to block the device 1 in position. From this moment on, the sleeves 10 and 20 can no longer move back closer together without venting air from the parting ram 50 which therefore remains constantly pressurized. The device is then locked and ready for use.

The operator then takes up the remote control 70 and positions himself as far away as possible, while still preferably having the door 100 and the device 1 in sight so as to monitor the progress of the breaking operation. Typically, given the length of the control flexes 55 and 35, the operator can position himself 5 meters away.

The operator then presses the second button 83 which is on the remote control 80 and has the effect of driving the parting ram 50 which thrusts this time via its end mounting plate 51 because the pawls 62 act as an end stop for the ram rod 52. This has the effect of causing the wedges 12 and 22 to penetrate the frame 104 of the door 100 even more deeply, particularly at the fastening points. The penetration force is typically between 5 and 20 kN, for example 13.5 kN, under an air pressure of 8 bar and with a longitudinal stroke of about 95 mm in total.

Two scenarios may then arise. In the first scenario, the uprights of the frame 104 are conventional and not very strong, for example made of wood. The wedges 12 and 22 used then penetrate between the opening part 102 and the frame 104 and the parting ram 50 reaches its maximum stroke. The thrust of the parting ram 50 and of the wedges 12 and 22 is then greater than the strength of the frame 104, which allows it to be deformed, particularly near the lock and/or the hinges. In the second scenario, the frame 104 is very strong, for example equipped with thick metal brackets. The wedges 12 and 22 then penetrate between the opening part 102 and the frame 104, and the parting ram 50 does not reach its maximum stroke; it allows the device to be held in position to facilitate the work of the percussion thrust ram 30.

The operator then operates the third button 85 on the remote control 80, and this has the effect of driving the percussion thrust ram 30. As has already been stated, the thrust ram 30 is placed as close as possible to the lock by virtue of the sliding ramp 14 formed on the outer sleeve 10. The elastic bellows 32 of the thrust ram inflates step by step under the pressure of the air and moves the bearing plate 38 against the opening part 102 of the door 100. Once the bearing plate 38 is correctly positioned, the operator presses again or continues to press the third button 85 so as to exert maximum pressure, typically about 45 kN, on the opening part 102 of the door 100, more or less at right angles to the latter. The bellows 38 continues to inflate under an air pressure of 15 bar and with a stroke of about 50 to 200 mm depending on the type of ram. The opening part 102 of the door deforms then under the effect both of the perpendicular thrust from the thrust ram 30 but also of the longitudinal parting of the parting ram 50 which deforms or detaches the uprights of the frame 104. If the door resists, the operator can then operate the thrust ram 30 several times in quick succession, for example every 5 to 10 seconds or even every 2 seconds approximately so as to exert repetitive percussive and reciprocating thrust on the door with a view to causing the closure points to yield. A special-purpose percussion control may incidentally be provided on the remote control to alternate the striking of the thrust ram, possibly with adjustment of the frequency and back/forth travel. Of course, during this operation, the parting ram remains constantly pressurized. Furthermore, the thrust ram 30 tolerates an angular deformation of about 20° at most by virtue of the bellows 38, this being in all directions, this flexible bellows 38 acting somewhat like a ball joint.

Once the door is opened, the device 1 generally remains in place, wedged by its wedges 12 and 22 embedded in the frame 104. All that is required is for the various rams to be vented very quickly using the valves 36 and 56, particularly the parting ram using the first button 26, and this in particular has the effect of unlocking the pawls 62 which return to their original position when the ram rod 52 retracts into the inner sleeve 20 and the lugs 24 come into contact with said pawls 62, as in the rest position illustrated in FIG. 4.

In the case of a very wide door, for example an industrial door and/or a double-leaf door, or in the event of essentially vertical positioning, it is possible to fit the extension piece 40 to the end of the outer sleeve 10, by virtue of the dovetail housing 13.

The device of the present invention can also be used "up in the air", that is to say, for example, to open a window of a building from the outside, possibly from a balcony. To do that, the two arms of a "Y"-shaped strap equipped with snap shackles are attached to the handgrips 18 and 28, while the main branch is attached for example to the railing of a balcony or to a firefighter's ladder. Thus, even if the device 1 becomes detached from the window while the window is being broken open, there is no risk of it falling and, for example, landing on people standing under the window. This additional safety measure is particularly useful when a flashover, that is to say the explosion of a fireball traveling at very high speed comes out of the window when the window is opened. Such an event, which is frequent, is, incidentally, a major cause of death among firefighters.

The device of the present invention may thus be fitted in all firefighting vehicles used for emergency interventions and also in some police or constabulary vehicles involved in upholding law and order (drug enforcement, organized crime, hostage situations) or rapid legal interventions.

It is stored in a tailor-made cover, preferably made of fire-retardant material, so that it can easily be transported to the site of the operation slung across somebody's body or on his back.

The numerous advantages of the present invention over the solutions of the prior art are as follows:

- very easy to use, even under extreme visibility conditions (smoke, low light levels);
- very safe because of the remote control that allows the intervention to be performed remotely, several meters away from the opening leaf;
- light weight of the device, weighing about 12-16 kg, because in particular of the use of titanium which is a material that is simultaneously lightweight, rustproof, and very resistant to impact and to heat;
- the physical effort involved both in carrying the device and handling it is small, which allows those involved to keep their physical condition intact in order to concentrate on saving the individuals that require assistance once the door has been opened;
- quick coupling to any type of compressed air cylinder typically used by firefighters;
- the fluid used is non-combustible;
- the use of air avoids complicated handling as is required in the use of a pneumatic ram. There is very little risk of the device breaking down, and it will therefore last longer;
- because of the use of compressed air, which in addition is always available in a fire truck, the frequency of the thrust is very quick by comparison with a hydraulic ram which takes a long time (several minutes) to vent. This is an additional token of safety both for those using it (mainly for the firefighters in the event of fire) and also for those being rescued, whose life may be in serious danger;
- little damage is caused to the door and its lateral upright; it is sometimes even possible to close the door again;
- the device can be placed in any configuration, for example at an angle, vertically or horizontally, and operate with any type of door, whether this be a single-leaf door, a double-leaf door, a narrow door, particularly one narrower than the device is long in its folded state, for example measuring 63 cm, or very wide door, for example in excess of 1 m wide,
- as the thrust ram is mounted to move on a displacement ramp, it can be positioned at the best location to increase the chances of rapidly opening the door without losing time;
- it is possible, by virtue of the compressed air coupling, to operate several devices simultaneously in parallel using one single remote control, so as to increase the strike force;

the area of the bearing plate is large enough to prevent the thrusting ram from punching through the door without opening it;

by virtue of the bellows of the thrusting ram which is able to tolerate an inclination of as much as 20°, the strike force of the bearing plate remains constant;

the two sleeves cannot disconnect and the parting ram operates always in an optimum manner by virtue of the pawls and of the fact that the parting ram pushes from the end, the power of this device greatly exceeds that of the devices of the prior art, making it usable for very high levels of armoring.

It must be understood, however, that the detailed description given solely by way of illustration of the subject of the invention does not in any way constitute a restriction, technical equivalents also being included in the scope of the present invention.

Thus, the device may also be used for opening an armored window making it possible, by virtue of its remote control, to avoid those involved becoming injured by broken glass.

The use of electric, hydraulic, chemically operated or other types of ram is entirely possible.

The handgrips may be articulated and arranged differently or may be more numerous, or alternatively may be open on one side and simply form an L rather than a U.

The invention claimed is:

1. A device for forcibly opening an opening leaf (100) of width (L) having an opening part (102) and a fixed frame (104) such as a door or window, comprising at least:

a length-extendable body (2) formed of two or more sliding parts (10, 20) so that it can be adapted to suit the width (L) of the opening leaf, a drive-in wedge (12; 22) intended to be positioned between the frame (104) and the opening part (102), a parting ram (50) to allow the wedge (12; 22) to penetrate between the frame (104) and the opening part (102) so as to forcibly open the opening leaf (100), and a thrusting ram (30) placed substantially at right angles to the body (2), the rams (30; 50) being remotely operable using at least one remote control (80), characterized in that the thrusting ram (30) is a continuous-thrust percussion ram with repetitive reciprocating action.

2. The device as claimed in claim 1, characterized in that the body (2) comprises an outer sleeve (10) inside which an inner sleeve (20) slides, a first, sharpened, drive-in wedge (12) being secured to the outer sleeve (10) and a second, sharpened, drive-in wedge (22) being secured to the inner sleeve (20).

3. The device as claimed in claim 2, characterized in that the wedges (12, 22) are positioned in an offset manner at the two opposing ends (10*a*, 20*a*) of the body (2) and each have more or less the shape of an "L".

4. The device as claimed in claim 2, in which the parting ram (50) is fixed, inside the inner sleeve (10), on a mounting plate (21) and allows the wedges (12, 22) to be driven in before the percussion thrust ram (30) is operated.

5. The device as claimed in claim 2, in which the percussion thrust ram (30) is slidably mounted on a ramp (14), preferably of the dovetail type, that positions it in the desired location, said ramp extending over practically the entire length of the outer sleeve (10).

6. The device as claimed in claim 5, in which the percussion thrust ram (30) comprises a bellows (32) to which there is secured a rigid bearing plate (38) that can be positioned facing the opening part (102) of the opening leaf (100).

7. The device as claimed in claim 6, in which the bellows (32) is made of flexible and pressure-resistant plastic so that the bearing plate (38) has a possible angular deformation of between 0° and substantially 20° about three perpendicular axes of rotation.

8. The device as claimed in claim 1, in which the body (2) comprises a blocking member (60) blocking longitudinal translation to allow the two sliding parts (10, 20) to be locked together before the percussion pressure ram (30) is operated.

9. The device as claimed in claim 8, in which the blocking member (60) comprises at least a longitudinal rack (15; 16) arranged on the internal surface of the outer sleeve (10) and equipped with blocking teeth (17), an articulated pawl (62) collaborating with the rack in order to be in or out of mesh with said teeth (17), and a return spring (64) for returning the pawl (62).

10. The device as claimed in claim 9, in which the blocking member (60) comprises:

two identical racks (15, 16) arranged substantially in opposition on the internal surface of the outer sleeve (10), two articulated pawls (62) mounted on a common slide (61) secured to the rod (52) of the parting ram (50) and connected to one another by two return springs (64), and two lugs (24) secured to a blanking plate (23) of the inner sleeve (20) and collaborating with the pawls (62) to keep them in the knocked-over position against the return force of the springs (64).

11. The device as claimed in claim 1, in which each ram (30; 50) is of the pneumatic type and has a respective quick coupling (34; 54) to a pressurized-air cylinder (70) and an exhaust valve (36; 56).

12. The device as claimed in claim 1, characterized in that the remote control (80) is connected to the rams (30, 50) by fire-resistant and crush-resistant flexes (35, 55) between one and several meters long, and has independent and easy-to-distinguish controls (83, 85) for each ram (5; 6).

13. The device as claimed in claim 12, in which the ram controls are push-buttons and the button (83) for controlling the parting ram (50) is more prominent on the remote control than the button (85) for controlling the thrust ram (30).

14. The device as claimed in claim 1, in which the body (2) has, at one end (10*a*, 20*a*) a housing (13) of the dovetail type arranged at right angles to its main direction of elongation so as to hold an extension piece (40).

15. The device as claimed in claim 1, in which the body (2) has two fixed or articulated handgrips (18, 28) arranged at its two opposite ends (10*a*, 20*a*) and made of a material resistant to violent impacts, to fire and to corrosion, such as titanium.

16. The device as claimed in claim 1, in which:

the parting ram (50) has a power of between 5 and 20 kN, preferably of 13.5 kN, and a stroke of about 50 to 100 mm, and 15 bar the percussion thrust ram (30) has a power of between 10 and 70 kN, preferably of substantially 45 kN, and a stroke of between about 50 and 200 mm.

17. The device as claimed in claim 1, characterized in that it is mainly made of a material exhibiting high mechanical strength and high resistance to fire and to corrosion, such as titanium.

18. The device as claimed in claim 1, characterized in that it can be used in parallel with other identical devices (1) connected to one another by quick couplings and operated using the same remote control (80).

* * * * *